US011555500B2

(12) United States Patent
Elorza Gomez

(10) Patent No.: US 11,555,500 B2
(45) Date of Patent: Jan. 17, 2023

(54) GUIDE VANE

(71) Applicant: MTU Aero Engines AG, Munich (DE)

(72) Inventor: Sergio Elorza Gomez, Karlsfeld (DE)

(73) Assignee: MTU Aero Engines AG, Munich (DE)

( * ) Notice: Subject to any disclaimer, the term of this patent is extended or adjusted under 35 U.S.C. 154(b) by 0 days.

(21) Appl. No.: 17/388,825

(22) Filed: Jul. 29, 2021

(65) Prior Publication Data

US 2022/0042514 A1 Feb. 10, 2022

(30) Foreign Application Priority Data

Aug. 4, 2020 (DE) ..... 10 2020 209 792.5

(51) Int. Cl.
*F04D 19/02* (2006.01)

(52) U.S. Cl.
CPC ..... *F04D 19/022* (2013.01)

(58) Field of Classification Search
CPC ..... F01D 17/16; F01D 17/162; F01D 5/141; F01D 5/148; F01D 9/041
See application file for complete search history.

(56) References Cited

U.S. PATENT DOCUMENTS

| | | | | |
|---|---|---|---|---|
| 4,856,962 | A | 8/1989 | McDow | |
| 5,520,511 | A * | 5/1996 | Loudet | F01D 17/162 415/161 |
| 5,931,636 | A * | 8/1999 | Savage | F01D 17/162 415/230 |
| 8,974,175 | B2 * | 3/2015 | Domereq | F02C 6/08 415/914 |
| 10,012,103 | B2 * | 7/2018 | Pachidis | F04D 29/684 |
| 2016/0341068 | A1 * | 11/2016 | Robertson, Jr | F01D 9/041 |
| 2020/0072075 | A1 * | 3/2020 | Sener | F01D 11/005 |

FOREIGN PATENT DOCUMENTS

| | | | |
|---|---|---|---|
| CN | 105715585 | B | 6/2016 |
| CN | 105715585 | B | 6/2019 |
| DE | 694 08 650 | T2 | 8/1998 |
| DE | 10257044 | B4 | 1/2005 |
| DE | 102005038176 | A1 | 3/2006 |
| DE | 102008058014 | A1 | 5/2010 |
| DE | 102015004649 | A1 | 10/2016 |
| EP | 1 505 263 | A1 | 2/2005 |
| EP | 3 339 572 | A1 | 6/2018 |
| JP | 6381425 | B2 | 8/2018 |

* cited by examiner

*Primary Examiner* — Topaz L. Elliott
*Assistant Examiner* — Jackson N Gillenwaters
(74) *Attorney, Agent, or Firm* — Barlow, Josephs & Holmes, Ltd.; David R. Josephs

(57) ABSTRACT

The present invention relates to a guide vane, in particular an outlet guide vane and/or a guide vane for a compressor stage of a gas turbine, wherein the vane has a vane blade with a first vane blade portion and a second vane blade portion, and the first vane blade portion can be reversibly rotated in relation to the second vane blade portion about an axis of rotation from a first position to a second position, wherein, in at least one profile portion of the vane blade, the axis of rotation is arranged outside of a profile of the first vane blade portion, and/or a profile of the first vane blade portion has a suction side with a first contour portion and a second contour portion, which, in particular, is adjoined thereto, and a profile of the second vane blade portion has a pressure-side contour portion.

11 Claims, 2 Drawing Sheets

GUIDE VANE

BACKGROUND OF THE INVENTION

The present invention relates to a guide vane and a compressor stage for a gas turbine as well as a turbomachine, in particular a gas turbine, comprising the guide vane, and a method for operating the turbomachine, in particular a gas turbine.

SUMMARY OF THE INVENTION

An object of implementing the present invention is to provide an improved guide vane and/or to improve the operation of a turbomachine, in particular a gas turbine.

This object is achieved by a guide vane and method of the present invention.

Another object of the present invention is achieved by a compressor stage for a gas turbine or a turbomachine, in particular a gas turbine, comprising a guide vane or a plurality of guide vanes described herein. Advantageous embodiments of the invention are discussed in detail below.

In accordance with one embodiment of the present invention, a guide vane has a vane blade, which, in turn, has a first vane blade portion and a second vane blade portion, wherein, in relation to the second vane blade portion, the first vane blade portion is reversibly rotatable, preferably is rotatably mounted, about an axis of rotation, from a first position to a second position.

Through a rotation about an axis of rotation, it is possible in one embodiment to provide compact, reliable, precise, and/or mechanically and/or aerodynamically favorable adjustment kinematics.

In one embodiment, the axis of rotation forms with a radial direction an angle that is at most 15°; in a further development, the axis of rotation extends in the radial direction. In this way, it is possible in one embodiment to realize especially advantageous adjustment kinematics.

An axial direction in one embodiment is parallel to a rotational or (main) machine axis of a turbomachine, in particular a gas turbine, for which or in which, in one embodiment, the guide vane is provided or arranged or is to be used; a circumferential or peripheral direction in one embodiment is a rotational direction around this rotational or (main) machine axis; a radial direction is a direction perpendicular to the axial direction and circumferential direction or a direction (directional axis) that intersects perpendicularly the rotational or (main) machine axis. In one embodiment, a through-flow direction is a direction of a provided or designed through-flow and/or a direction from a leading edge to a trailing edge of the guide vane or of its vane blade and/or parallel to the rotational or (main) machine axis or axial direction and/or, in in one embodiment, parallel to the rotational or (main) machine axis or axial direction, and/or in one embodiment, parallel to the rotational or (main) machine axis or axial direction, from an inlet to an outlet of the gas turbine, accordingly "upstream", in one embodiment in or with respect to or along the axial direction in the direction towards the leading edge or towards the inlet, "downstream" in the direction towards the trailing edge or towards the outlet, in one embodiment in or with respect to or along the axial direction towards the trailing edge or towards the outlet. A leading edge is correspondingly an upstream edge or further upstream edge or an edge that is nearer to the inlet and a trailing edge is correspondingly a downstream edge or further downstream edge or an edge that is nearer to the outlet. In one embodiment, a furthest upstream point of a section of a vane blade or of its first or second vane blade portion with a cylinder around the rotational or (main) machine axis is a leading edge and a furthest downstream point of this section, that is, at the same radial height, is a trailing edge of a profile (profile section) of this vane blade (vane blade portion), the connecting line is a (profile) chord of this profile (profile section) and the profile or the profile section itself, in particular a planar, (cross) section that contains this (profile) chord and is perpendicular to a (straight line) of the shortest connection between the rotational or (main) machine axis and the (profile) chord. In one embodiment, radially successive profiles (profile sections) and, in one embodiment, profiles (profile sections) threaded along the thread axis define or form the vane blade or its outer contour and, correspondingly, elements of this profile or these profiles (profile sections) as profiles (profile sections) define or form the first vane blade portion or its outer contour and other elements of this profile or these profiles (profile sections) define or form the second vane blade portion or its outer contour. Profile and profile section can, in particular, be equivalent in meaning.

In accordance with one embodiment of the present invention, in one profile (profile section) or in a plurality of profiles (profile sections) of the vane blade, the axis of rotation is arranged outside of a profile (profile section) of the first vane blade portion. In one embodiment, the axis of rotation is arranged outside of the vane blade.

In this way, it is possible in one embodiment to realize especially advantageous adjustment kinematics.

Additionally or alternatively, in accordance with one embodiment of the present invention, in one profile (profile section) or in a plurality of profiles (profile sections) of the vane blade

- a profile (profile section) of the first vane blade portion has a suction side having a first and, in one embodiment, an adjoining, in particular upstream, second contour portion and
- a profile (profile section) of the second vane blade portion has a pressure-side contour portion, wherein

- in the first position, the first contour portion of the first vane blade portion overlaps the pressure-side contour portion of the second vane blade portion in the circumferential direction and
- in the second position, in contrast, the second contour portion of the first vane blade portion overlaps the pressure-side contour portion of the second vane blade portion in the circumferential direction.

In one embodiment, in the first position, a first portion of the suction side of the first vane blade portion overlaps a portion of the pressure side of the second vane blade portion in the circumferential direction and, in the second position, in contrast, a second portion of the suction side of the first vane blade portion overlaps this portion of the pressure side of the second vane blade portion in the circumferential direction.

In this way, it is possible in one embodiment to realize an adjustment of the guide vane that, in particular aerodynamically and/or mechanically, is especially advantageous and, in one embodiment, is low-loss, compact, simple, and/or reliable.

In accordance with one embodiment, it is possible to arrange the rotatable first vane blade portion in a through-flow direction upstream and the second vane blade portion, as viewed in a through-flow direction, downstream of the first vane blade portion.

Through an adjustment of the upstream first vane blade portion with respect to the downstream second vane blade portion, it is possible in one embodiment advantageously to compensate, at least in part, for variations in an angle of inflow or angle of incidence and, in one embodiment with such a variation, the usually ensuing pressure losses and/or reductions in efficiency are reduced.

In accordance with a further embodiment, which optionally can be claimed independently, the rotatable first vane blade portion is arranged in a through-flow direction downstream and the second vane blade portion, as viewed in a through-flow direction, is arranged upstream of the first vane blade portion. This permits the outflow conditions to be varied in an advantageous manner.

Additionally or alternatively, in accordance with one embodiment of the present invention, in a profile (profile section) or in a plurality of profiles (profile sections) of the vane blade, a, in particular the, profile (profile section) of the second vane blade portion has, in at least one point that lies in a furthest upstream or nearest tenth distance from the leading edge, in one embodiment, in a furthest upstream or nearest twentieth distance from the leading edge, of a or the suction side of this profile (profile section) of the second vane blade portion, a suction-side tangent (at the profile or the profile portion of the second vane blade portion); and a, in particular the, profile (profile section) of the first vane blade portion has a tangent, in a (suction-side) point that is situated nearest to this point of the suction side of the profile (profile section) of the second vane blade portion in the first or second position, this tangent (at the profile or the profile portion of the first vane blade portion) forming with this suction-side tangent an angle of at least 20°.

In this way, it is possible in one embodiment to reduce the negative effect of a leakage (back)flow between the first vane blade portion and the second vane blade portion and, in particular, to reduce the danger of a separation of this flow from the suction side of the second vane blade portion.

Additionally or alternatively, in accordance with one embodiment of the present invention, the first vane blade portion is separated from the second vane blade portion by a gap, in particular a contact gap or gap, in which the first vane blade portion and the second vane blade portion contact each other, or a free gap or gap, in which the first vane blade portion and the second vane blade portion do not contact each other or the first vane blade portion and the second vane blade portion are unconnected.

Additionally or alternatively, in accordance with one embodiment of the present invention, the first vane blade portion is arranged at, in one embodiment on, at least one platform that can rotate around the axis of rotation, being rotatably mounted in one embodiment, in particular a rotary plate, and, in one embodiment, at or on two platforms or rotary plates that lie radially opposite each other, between which the first vane blade portion is arranged. In one embodiment, the first vane blade portion comprising the platform or one of the platforms or both platforms or rotary plates is designed to be detachable without any destruction and, in particular, is designed in a friction-fitting and/or form-fitting manner, or else is designed so as not to be detachable without destruction and, in particular, is designed in a material-bonded, joined, or integral manner. Additionally or alternatively, in one embodiment, the first vane blade portion is arranged at the rim of the platform or one of the platforms or both platforms or rotary plates.

In this way, it is possible in one embodiment to realize an especially advantageous, in one embodiment low-loss, compact, simple, and/or reliable, adjustment of the guide vane.

In one embodiment, a distance to the axis of rotation varies along the first contour portion of the first vane blade portion by at most 10%, in particular by at most 5%, in one embodiment by at most 1%, and, in particular, the first contour portion can accordingly be a segment of a (first) circle around the axis of rotation.

Additionally or alternatively, in one embodiment, a distance to the axis of rotation along the second contour portion of the first vane blade portion varies by at most 10%, in particular by at most 5%, in one embodiment by at most 1%, and, in particular, the second contour portion can accordingly be a segment of a circle, in particular of the first circle, around the axis of rotation.

Additionally or alternatively, in one embodiment, a distance to the axis of rotation along the pressure-side contour portion of the second vane blade portion varies by at most 10%, in particular by at most 5%, in one embodiment by at most 1%, and, in particular, the pressure-side contour portion can accordingly be a segment of a circle, in particular a circle that is concentric to the first circle, around the axis of rotation.

Accordingly, in one embodiment, the first vane blade portion has a cone- or cylinder-like region, which has the contour portion or the first and second contour portions, and/or the second vane blade portion has a cone- or cylinder-shaped region, which, in particular, is congruent to the former region, which has the pressure-side contour portion or portions.

In this way, it is possible in one embodiment to realize an especially advantageous, in one embodiment low-loss and/or compact, adjustment of the guide vane.

In one embodiment, the guide vane has a seal, in one embodiment an elastic seal and/or a contacting, seal, in one embodiment a lip seal or a brush seal, which reduces a gap width between opposite-lying regions of the first and second vane blade portions in the first position and/or second position or is provided, in particular set up, or is used to this end. The seal can, in particular, be arranged at the second vane blade portion, in particular at the pressure-side contour portion of the second vane blade portion, and/or at the first vane blade portion, in particular at the first and/or second contour portion of the first vane blade portion.

In this way, it is possible in one embodiment to realize an especially advantageous, in one embodiment low-loss, adjustment of the guide vane.

In one embodiment, the axis of rotation is arranged on the side of the pressure side of the vane blade or lateral to the pressure side of the vane blade.

Additionally or alternatively, the axis of rotation in one embodiment is arranged in the at least one profile portion of the vane blade, in one embodiment in the axial direction, downstream towards or upstream in front of a leading edge of the profile (profile section) of the second vane blade portion. In one embodiment, the axis of rotation is arranged, in one embodiment in the axial direction, downstream after a leading edge of the second vane blade portion.

Additionally or alternatively, the axis of rotation in one embodiment is arranged in the at least one profile portion of the vane blade, in one embodiment in the axial direction, upstream in front if a trailing edge of the profile (profile section) of the second vane blade portion. In one embodiment, the axis of rotation is arranged, in one embodiment in the axial direction, upstream in front of a trailing edge of the second vane blade portion.

Additionally or alternatively, the axis of rotation in one embodiment is arranged in the first position and/or second position in the at least one profile portion of the vane blade, in one embodiment in the axial direction, downstream towards a leading edge of the profile (profile section) of the first vane blade portion. In one embodiment, the axis of rotation in the first position and/or second position is arranged, in one embodiment in the axial direction, downstream towards a leading edge of the first vane blade portion.

Additionally or alternatively, the axis of rotation in one embodiment is arranged in the at least one profile portion of the vane blade outside of the profile (profile section) of the second vane blade portion. In one embodiment, the axis of rotation is arranged outside of the second vane blade portion.

In this way, it is possible in one embodiment to realize an adjustment of the guide vane that, in particular aerodynamically and/or mechanically, is especially advantageous and, in one embodiment, is low-loss, compact, simple, and/or reliable.

In one embodiment, the guide vane has an outer shroud, which, in one embodiment, is arranged radially outside the vane blade, and/or an inner shroud, which, in one embodiment, is arranged radially inside the vane blade.

In one embodiment, the first vane blade portion is arranged rotatably, in one embodiment via the platform or one of the platforms, around the axis of rotation at the outer shroud and, in one embodiment, is mounted rotatably.

Additionally or alternatively, in one embodiment, the first vane blade portion is arranged rotatably, in one embodiment via the platform or one of the platforms, around the axis of rotation at the inner shroud and, in one embodiment, is rotatably mounted.

Additionally or alternatively, in one embodiment, the second vane blade portion is arranged in a fixed manner, in particular in a rotationally fixed manner, in one embodiment in a positionally fixed manner, at the outer shroud and, in one embodiment, can be detached from the outer shroud without any destruction and, in particular, is designed in a friction-fitting manner and/or form-fitting manner or else cannot be detached without destruction and, in particular, is designed in a material-bonded, joined, or integral manner.

Additionally or alternatively, in one embodiment, the second vane blade portion is arranged at the inner shroud in a fixed manner, in particular in a rotationally fixed manner, in one embodiment in a positionally fixed manner and, in one embodiment, can be detached from the inner shroud without destruction and, in particular, is designed in a friction-fitting manner and/or form-fitting manner or else cannot be detached without destruction and, in particular, is designed in a material-bonded, joined, or integral manner.

In this way, it is possible in one embodiment to realize an adjustment of the guide vane that, in particular aerodynamically and/or mechanically, is especially advantageous and, in one embodiment, is low-loss, compact, simple, and/or reliable.

The present invention is especially suitable for gas turbines and, in particular, for their compressor stages and/or outlet guide baffle or grid and, in one embodiment, is correspondingly especially suitably used or employed for this purpose, that is, as or in a compressor stage outlet guide baffle of a gas turbine, in particular an aircraft engine gas turbine, without being limited thereto, however.

In accordance with one embodiment of the present invention for operation or during operation of a turbomachine, in particular a gas turbine, the first blade portion or portions of one or a plurality of the guide vanes described here is or are adjusted or rotated, in one embodiment synchronously, from the first position to the second position.

In one embodiment, an axial distance between a leading edge of the first vane blade portion and a trailing edge of the second vane blade portion of the guide vane(s) in the second position or an axial extension of the guide vane(s) in the second position is shorter than in the first position. Additionally or alternatively, in one embodiment, a distance in the circumferential or peripheral direction between a leading edge of the first vane blade portion and a leading or trailing edge of the suction side of the second vane blade portion of the guide vane(s) in the second position or an axial extension of the guide vane(s) in the second position is shorter than in the first position.

Additionally or alternatively, in one embodiment, the first vane blade portion of the guide vane or the first vane blade portions of the guide vanes is or are adjusted or rotated to the second position, in operation or for operation, in an operating point with a (more) suction-side angle of inflow, and/or to the first position, in operation or for operation, in an operating point with a (more) pressure-side angle of inflow.

In this way, it is possible in one embodiment to improve the operation of the turbomachine, in particular the gas turbine, in particular its efficiency.

Of course, in addition to the first and second positions, yet further intermediate positions and/or positions that go beyond the first or second position or angular positions are possible; in particular, in one embodiment, the first vane blade portion can be adjusted or rotated, preferably continuously, to positions between the first position and second position and/or beyond the first position and/or second position.

BRIEF DESCRIPTION OF THE DRAWING FIGURES

Additional advantageous further developments of the present invention ensue from the dependent claims and the following description of preferred embodiments. Shown for this purpose, in a partly schematic manner, are:

DESCRIPTION OF THE INVENTION

Figure 1:
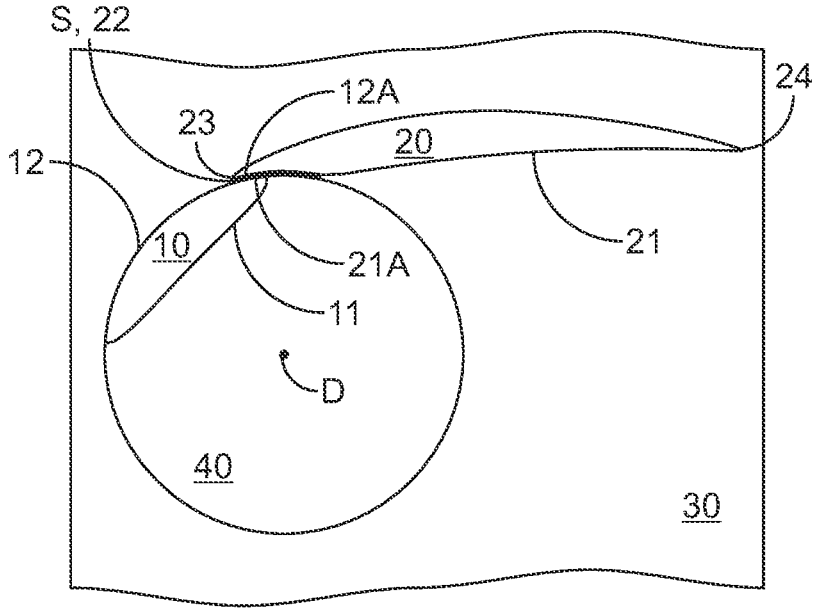
FIG. 1 shows a guide vane in accordance with an embodiment of the present invention in a first position.

FIG. 1 shows a profile portion of a vane blade of a guide vane in accordance with an embodiment of the present invention in a first position.

The vane blade has an upstream first vane blade portion 10, which, in the profile section of FIG. 1, has a profile (profile section) 11 with a suction side 12, and, in a through-flow direction (from left to right in FIG. 1), a second vane blade portion 20, which, in the profile section of FIG. 1, has a profile (profile section) 21.

The second vane blade portion 20 is arranged at an outer shroud 30 in a fixed manner.

The first vane blade portion 10 is separated from the second vane blade portion by a gap S, in which a seal 22, which reduces, at least essentially, the gap width to zero, is arranged at the second vane blade portion 20. The first and second vane blade portions can contact each other or, equally, a free gap can be created between them.

The first vane blade portion 10 is arranged at a platform 40 that can rotate around an axis of rotation D and, via this platform 40, is mounted rotatably around the axis of rotation D at the outer shroud 30. At the radially (perpendicular to the plane of the drawing in FIG. 1) opposite-lying ends of the guide vane, which are therefore not visible in FIG. 1, it is possible in an analogous way to arrange the guide vane at an inner shroud, or a design without an inner shroud is also possible.

The axis of rotation D is arranged on the side of the pressure side (bottom in FIG. 1) and, in the profile section of FIG. 1, outside of the profile 11 of the first vane blade portion 10, downstream towards a leading edge 23, upstream in front of a trailing edge 24, and outside of the profile 21 of the second vane blade portion 20.

The suction side 12 of the profile 11 of the first vane blade portion 10 has a first contour portion 12A and, adjoining it upstream, a second contour portion 12B; the profile 21 of the second vane blade portion 20 has a pressure-side contour portion 21A.

In the first position shown in FIG. 1, the first contour portion 12A overlaps the pressure-side contour portion 21A in the circumferential or peripheral direction (vertical in FIG. 1).

Figure 2:
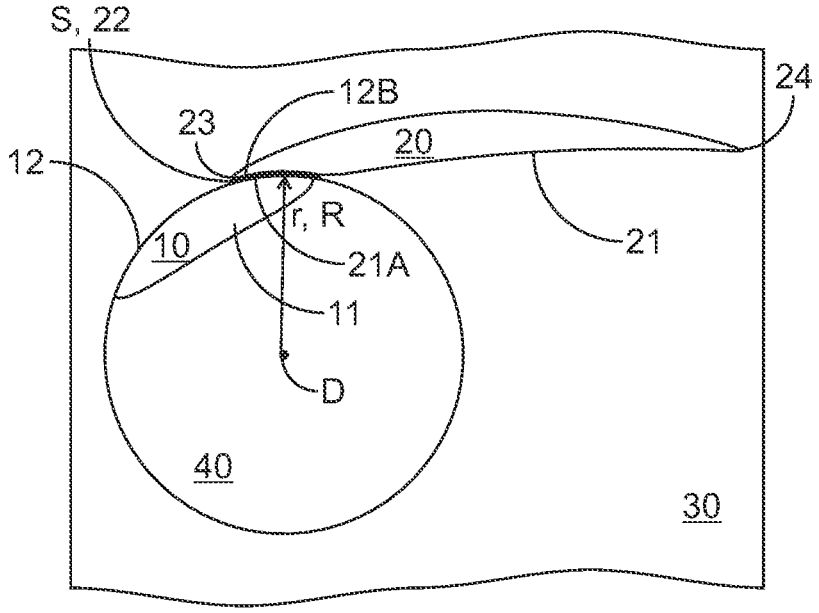
FIG. 2 shows the guide vane in a second position.

When an angle of inflow of the guide vane is adjusted towards the suction side (towards the top in FIG. 1) or becomes more suction-side, the first vane blade portion 10 is adjusted or rotated (twisted) around the axis of rotation D to the second position shown in FIG. 2.

In this second position, instead of the first contour portion 12A, now the second contour portion 12B overlaps the pressure-side contour portion 21A in the circumferential direction (the first contour portion 12A hereby overlaps another (pressure-side) contour portion of the profile (profile section) 21 of the second vane blade portion 20). In other words, the rotation from the first position to the second position brings the second contour portion 12B, in relation to the second vane blade portion 20, to the position of the first contour portion 12A.

When the angle of inflow is adjusted towards the pressure side (towards the bottom in FIG. 1) or becomes more pressure-side, the first vane blade portion 10 is adjusted or rotated (twisted) around the axis of rotation D back to the first position shown in FIG. 1.

Clearly, besides the first and second positions, yet further intermediate positions and/or positions or angular positions going beyond the first or second position are possible.

In the exemplary embodiment, the first and second contour portions 12A, 12B are, at least essentially, circular segments of the same circle and the pressure-side contour portion 21A is, at least essentially, a circular segment of a circle concentric to the former circle, so that the distances r, R to the axis of rotation D along these contour portions are, at least essentially, constant.

Figure 3:
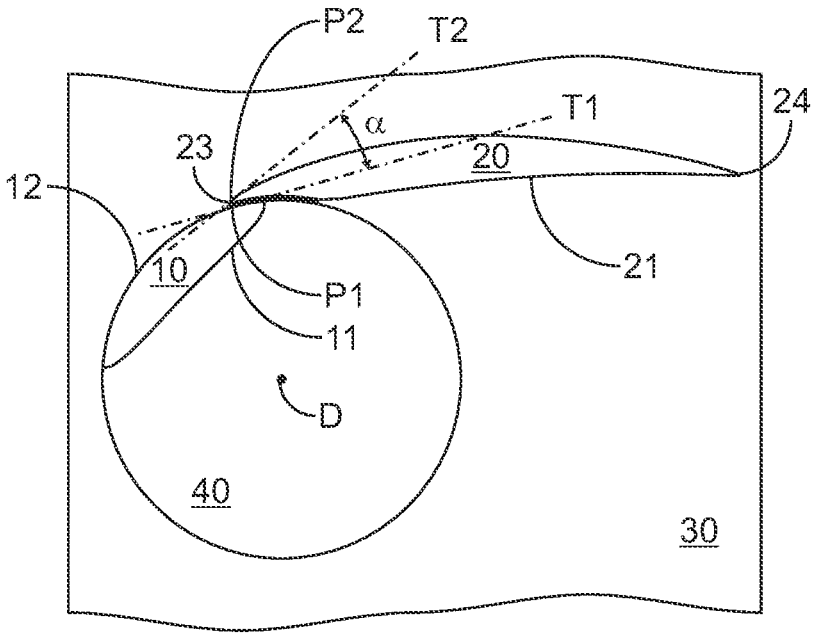
FIG. 3 shows the guide vane in the first position with inscribed tangents.

FIG. 3 shows the profile section of FIG. 1, with a point P2 being inscribed that lies in a furthest upstream twentieth part of the suction side (top in FIG. 3) of the second vane blade portion 20 or profile (profile section) 21, that is, a suction-side point in the region or in the vicinity of the leading edge 23.

Additionally inscribed is the point P1, nearest-lying to this point P2, of the suction side of the first vane blade portion 10 or profile (profile section) 11.

Moreover, the suction-side tangent T2 in the point P2 (at the suction side of the second vane blade portion 20 or profile (profile section) 21) and the suction-side tangent T1 in the point P1 (at the suction side of the first vane blade portion 10 or profile (profile section) 11) as well as the angle $\alpha$ between these two tangents T1, T2, which is greater than 20°, are drawn in.

As a result of this, the danger of a separation of a leakage (back)flow, which flows between the two vane blade portions 10, 20 through the gap towards the leading edge 23 of the second vane blade portion 20, from the suction side of the second vane blade portion 20 or profile (profile section) 21 is diminished.

Even though exemplary embodiments were explained in the preceding description, it is noted that a large number of modifications are possible. Moreover, it is noted that the exemplary embodiments are merely examples, which are not intended to limit the scope of protection, the applications, and the design in any way. Instead, the preceding description affords the person skilled in the art a guideline for implementing at least one exemplary embodiment, with it being possible to make diverse changes, particularly in regard to the function and arrangement of the described component parts, without departing from the protective scope as it ensues from the claims and the combinations of features equivalent thereto.

What is claimed is:

1. A guide vane for a compressor stage of a gas turbine, wherein the guide vane has a vane blade with a first vane blade portion and a second vane blade portion and the first vane blade portion is configured and arranged to be rotated reversibly in relation to the second vane blade portion about an axis of rotation from a first position to a second position, wherein, in at least one profile portion of the vane blade, the axis of rotation is arranged outside of a profile of the first vane blade portion and/or a profile of the first vane blade portion has an suction side with a first contour portion and a second contour portion, which is adjoined thereto, and a profile of the second vane blade portion has a pressure-side contour portion, which, in the first position, is overlapped by the first contour portion and, in the second position, is instead overlapped by the second contour portion in the circumferential or peripheral direction; the first contour portion and the second contour portion are circular segments of a same circle wherein a distance from the axis of rotation to the first contour portion and a distance from the axis of rotation to the second contour portion are the same; and wherein the first vane blade portion is separated from the second vane blade portion by a gap and is arranged on at least one platform that is configured and arranged to rotate about the axis of rotation.

2. The guide vane according to claim 1, wherein the second vane blade portion lies, as viewed in a through-flow direction, downstream of the first vane blade portion.

3. The guide vane according to claim 1, wherein the second vane blade portion lies, as viewed in a through-flow direction, upstream of the first vane blade portion.

4. The guide vane according to claim 2, wherein the profile of the second vane blade portion has a suction-side tangent in at least one point in a furthest upstream tenth part of its suction side, and the profile of the first vane blade portion has a tangent in point in the first or second position lying nearest to the at least one point in a furthest upstream tenth part of its suction side, these tangents forming an angle of at least 20° with each other.

5. The guide vane according to claim 1, wherein a distance to the axis of rotation varies along the first contour portion by at most 10%, a distance to the axis of rotation varies along the second contour portion by at most 10%, and/or a distance to the axis of rotation varies along the pressure-side contour portion by at most 10% and the first vane blade portion has a cone-shaped or cylinder-shaped region, which has the first and second contour portions, and/or the second vane blade portion has a cone-like or cylinder-like congruent region, which comprises the pressure-side contour portion.

6. The guide vane according to claim 1, further comprising a seal, which is an elastic seal and/or a contacting seal, for reducing a gap width between opposite-lying regions of the first and second vane blade portions in the first position and/or second position.

7. The guide vane according to claim 1, wherein the axis of rotation is arranged on the side of the pressure side and/or in the at least one profile portion of the vane blade downstream towards or upstream in front of a leading edge and/or upstream in front of a trailing edge and/or outside of the profile of the second vane blade portion.

8. The guide vane according to claim 1, further comprising an outer shroud and/or an inner shroud, at which the first vane blade portion is rotatably arranged via the at least one platform, around the axis of rotation, and/or the second vane blade portion is arranged in a fixed position.

9. The guide vane according to claim 1, wherein the guide vane is an outlet guide vane that is configured and arranged in a compressor stage for a gas turbine.

10. The guide vane according to claim 1, wherein the at least one guide vane is configured and arranged in a compressor stage of a gas turbine.

11. The guide vane according to claim 1, wherein the first vane blade portions of a plurality of the vane blades are adjustable from the first to the second position.

* * * * *